United States Patent [19]

Merrill

[11] Patent Number: 4,653,557

[45] Date of Patent: Mar. 31, 1987

[54] SLOT CUTTING MACHINE

[76] Inventor: Gerard L. Merrill, 3116 Hansen Cir., Tempe, Ariz. 85282

[21] Appl. No.: 764,214

[22] Filed: Aug. 9, 1985

[51] Int. Cl.[4] ..... B27C 5/06

[52] U.S. Cl. ..... 144/136 R; 144/1 R; 144/82; 144/84; 144/253 R; 144/245 R; 144/371; 269/228; 408/43; 408/53

[58] Field of Search ..... 408/43, 53, 50; 144/82, 144/84, 136 R, 136 G, 218, 253 R, 371, 245 R, 242 R; 269/228, 90

[56] References Cited

U.S. PATENT DOCUMENTS

| | | | |
|---|---|---|---|
| 194,304 | 8/1977 | Levin | 144/82 |
| 2,542,615 | 2/1951 | Balazs | 144/136 R |
| 2,726,692 | 12/1955 | Collignon | 144/253 R |
| 2,888,965 | 6/1959 | Phillips | 144/1 R |
| 3,807,718 | 4/1974 | Sendoykas | 269/228 |
| 3,994,326 | 11/1976 | Sarten | 144/136 R |
| 4,422,488 | 12/1983 | Lacroix et al. | 144/368 |

FOREIGN PATENT DOCUMENTS 814791 7/1949 Fed. Rep. of Germany .

*Primary Examiner*—W. D. Bray

*Attorney, Agent, or Firm*—Don J. Flickinger; Jordan M. Meschkow

[57] ABSTRACT

A cross slide for receiving and locationally holding an elongate workpiece, such as a picture frame member, is supported upon a carriage which is reciprocally movable along an axis which is parallel to the longitudinal axis of the workpiece. The cross slide is laterally movable to bring the face surface of the workpiece against an adjustable stop carried by the carriage. In response to forward movement of the carriage, the workpiece is intercepted by a rotating cutting tool which cuts an elongate, longitudinally extending slot into the workpiece from the rear surface thereof at a predetermined distance from the face surface regardless of the thickness of the workpiece.

19 Claims, 14 Drawing Figures

FIG. 3
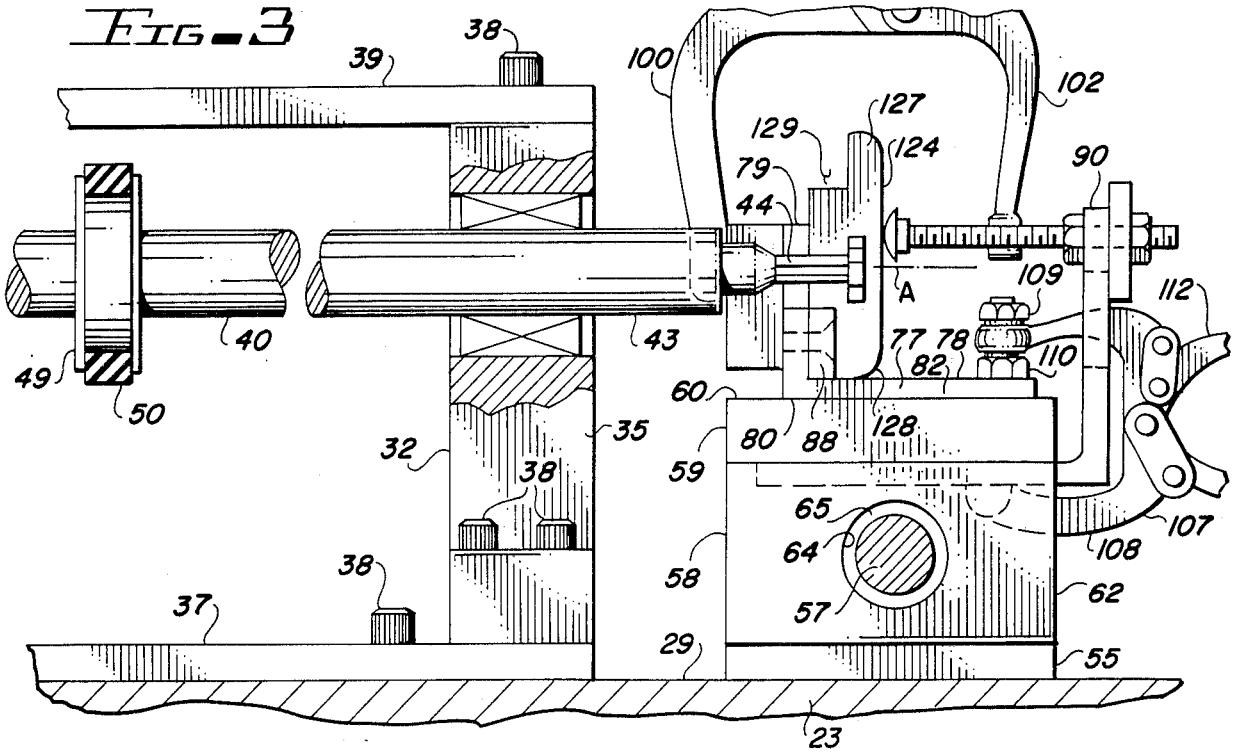
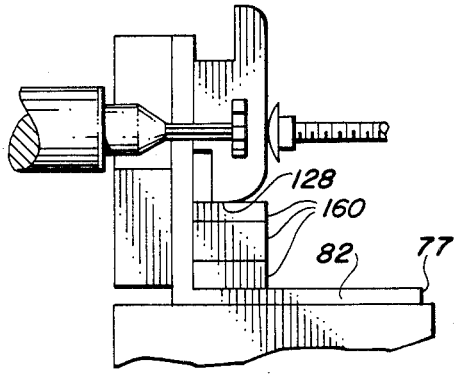
FIG. 11
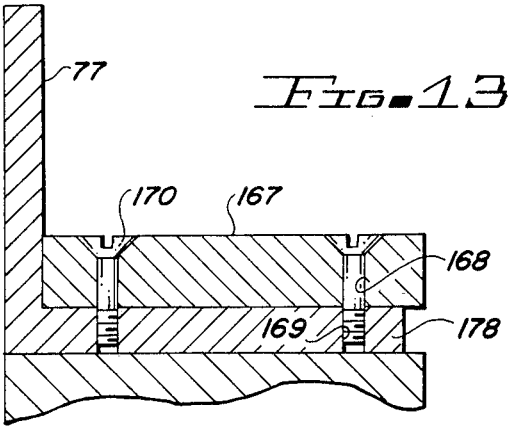
FIG. 13
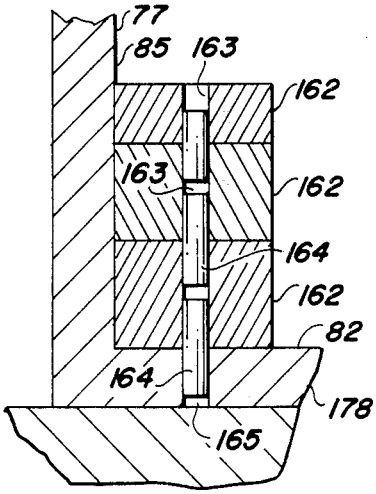
FIG. 12
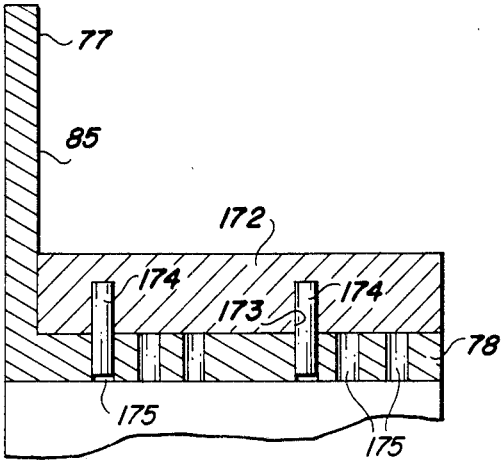
FIG. 14

SLOT CUTTING MACHINE

BACKGROUND OF THE INVENTION

1. Field of the Invention

This invention relates to machine tools.

More particularly, the present invention relates to machinery for forming a slot or groove into a workpiece.

In a further and more specific aspect, the instant invention concerns a machine especially adapted for cutting a groove for aligned joining of two or more members.

2. The Prior Art

Various types of frames, such as picture frames, typically include a plurality of elongate members which are abutted and joined, end-to-end, to form a parametric structure. A continuous rabbet extends about the inner edge of the normally flat backside for receiving the glass, picture or other display item. Usually the face side is ornamentally sculptured.

In order to insure continuity of the design carried upon the face side, a miter joint is employed at each corner of the structure. The abutting ends of the members are joined by various means such as mechanical fastening devices and adhesives. As will be readily recognized by those skilled in the art, fabrication of a frame structure in accordance with conventional practice requires specialized equipment and professional skills.

Consistent with the popularity of do-it-yourself projects, manufacturers have provided pre-cut frame members which are adapted to be assembled by persons of lesser skills. The members, which are commonly available in wood or metal, are joined by various means. Wood members, for example, are frequently united by a tongue and groove joint, the elements being carried by the respective mitered ends of the ajoining members. The prior art has also provided a shallow groove on the rear side of the members for receiving a conventional corner bracket which is affixed by screws.

Metal members are joined by various fastening devices. Exemplary is the specialty joining bracket such as the one distributed by Neilson Design, Townson, Mass., under the tradename Tabbed Corner TM. The device includes a planar, generally L-shaped element bearing a visual similarity to a conventional corner bracket. A set screw is carried in each of several threaded apertures extending through the legs of the element. The especially devised companion metal members each include a longitudinally extending T-slot, the narrow portion of which is open along the backside. During assembly, respective legs of the element are inserted into the slots of the members to be joined. THe screws are then rotated, as by a screw driver passing through the narrow portion of the slot, whereby the screws and the legs are brought into compression within the elements.

Corner brackets, either of conventional or specialty ilk, are exceedingly desirable for joining the members of a frame structure. The mechanical bond is conveniently and readily affected. Simultaneously, without exertion of extra care or effort, the angle between the adjacent members is spontaneously established as is the planarity of the structure. As an additional benefit, specialty brackets eliminate the necessity of penetrating the members with mechanical fastening means, such as screws.

Heretofore, however, corner brackets have proven to be less than entirely satisfactory in the fabrication of a wooden frame structure. Planar alignment of the members is established with respect to the surface of the groove against which the bracket is received. Metal members, usually fabricated by the extrusion process, are of uniform dimensions. Accordingly, all surfaces of the several frame members are brought into registry during assembly.

Wood, of the type normally used in frame structures, is not of uniform thickness. In accordance with industrial standards, deviation of approximately one-sixty fourth inch from nominal measurement is acceptable. Further, the prior art has taught that the bracket receiving groove, for purposes of machining, be located from the rear side of the member. Resultingly, the assembled frame structure includes a back side which is smooth and even, while the face surface may have variations as great as one-thirty second inch.

As previously noted, the face side of the frame structure is generally sculptured for aesthetic purposes. To accommodate individual considerations and to enhance and compliment selected display material, manufacturers have made available an almost limitless variety of designs and configurations. Yet, misalignment of the face side of the members, which are presented for viewing along with the framed display, materially subtracts from the intended affect.

Misalignment of members having relatively flat or nonornamental face surfaces can be partially corrected or obscured by the use of sandpaper. The result is generally less than perfection. On the other hand, ornamental surfaces are untouchable. Consequently, as will be readily appreciated by those skilled in the art, assembly of fine frame structures has largely remained the domain of highly skilled professionals.

It would be highly advantageous therefore to remedy the foregoing and other deficiencies inherent in the prior art.

Accordingly, it is an object of the present invention to provide improvements in the fabrication of frame structures.

Another object of the invention is the provision of improved means for assembling frame members.

And another object of the invention is to provide an improved machine for cutting bracket receiving grooves into the members of a frame structure.

Still another object of the instant invention is the provision of a machine for forming a groove at a predetermined location on the members.

Yet another object of the invention is to provide means for the automatic alignment of the face sides of the members during assembly of the frame structure.

Yet still another object of this invention is the provision of a machine having means for locating the frame members from the face side thereof.

Another object of the invention is to provide a machine having locating means which will accommodate variously contoured frame members.

And another object of the immediate invention is the provision of a machine especially adapted for the mass production of automatically aligning frame members.

Yet another object of the invention is the provide a machine which is relatively simple and easy to set up and use.

Still another object of the invention is the provision of a machine according to the foregoing which is comparatively uncomplicated inexpensive to manufacture.

SUMMARY OF THE INVENTION

According to a broad aspect of the invention there is provided an apparatus for cutting a longitudinal groove in a workpiece having a face surface, a rear surface, inner and outer edges, and first and second ends, for the aligned joining of at least two such workpieces, comprising a base having a forward end, a rearward end, a right side, a left side, and an upper surface; first means coupled to the base for locating and supporting the workpiece; and second means coupled to the base for cutting a longitudinal groove in the workpiece to a depth which is a predetermined distance from the face surface.

Other objects, features and advantages will be better understood from the following detailed description.

BRIEF DESCRIPTION OF THE DRAWINGS

The foregoing and further and more specific objects and advantages of the instant invention will become readily apparent to those skilled in the art from the following detailed description of preferred embodiments thereof, taken in conjunction with the drawings in which:

FIG. 3 is an enlarged vertical sectional view taken along the line 3—3 of FIG. 2;

FIG. 11 is a fragmentary portion of the illustration of FIG. 3 showing yet an alternate embodiment of the invention;

FIG. 12 is a view generally corresponding to the view of FIG. 11 and illustrating a further embodiment thereof;

FIG. 13 is a view generally corresponding to the illustration of FIG. 11 and showing a further embodiment of the instant invention; and FIG. 14 is a view corresponding to the illustration of FIG. 13 and showing yet a further embodiment thereof.

DETAILED DESCRIPTION OF THE PREFERRED EMBODIMENTS

Figures 1, 4, 5, 6:
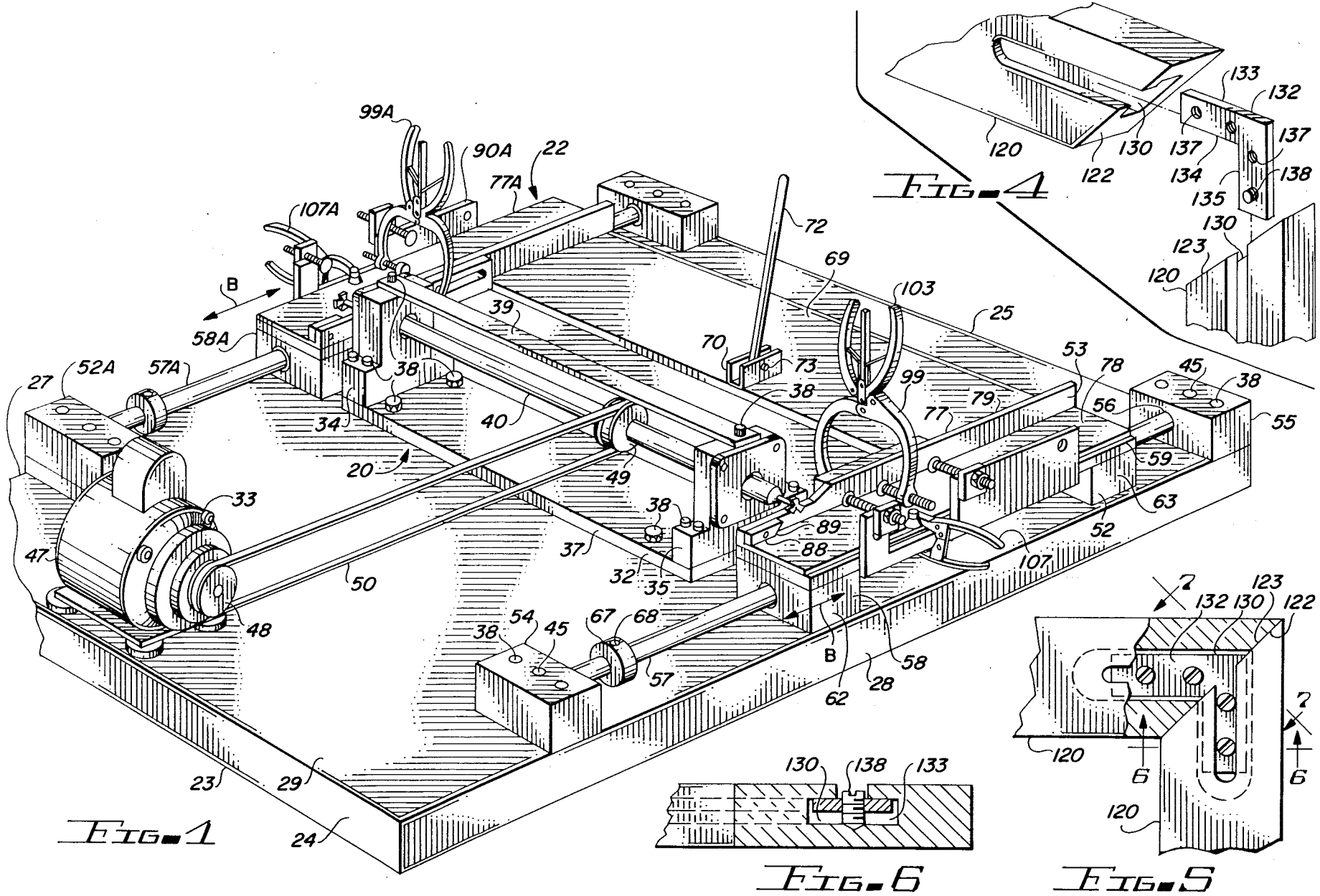
FIG. 1 is a perspective view of a machine especially adapted for preparing frame members and incorporating the principles of the instant invention.
FIG. 4 is a fragmentary exploded view of a corner of a frame structure incorporating members prepared by the machine of FIG. 1.
FIG. 5 is a rear elevation view of the assembled components seen in FIG. 4, a portion thereof being broken away for purposes of illustration.
FIG. 6 is a horizontal sectional view taken along the line 6—6 of FIG. 5.

Turning now to the drawings, in which like reference characters indicate corresponding elements throughout the several views, attention is first directed to FIG. 1 which illustrates a machine including first means, generally designated by the reference character 20, for holding and rotating a cutting tool and second means, generally designated by the reference character 22, for locating and supporting a workpiece. First means 20 and second means 22, which embody the principles of the instant invention and cooperate to prepare frame members in accordance with the teachings thereof, are illustrated as mounted upon a base 23 for purposes of convenience and portability. For purposes of understanding and orientation throughout the ensuing description, base 23 is considered to have forward end 24, rearward end 25, right side 27, left side 28 and top surface 29. The portions of base 23 are designed with respect to the operator's normal position which is adjacent rearward end 25.

First means 20 includes spindle means 32 for rotatably supporting a cutting tool and drive means 33 for imparting rotary motion to spindle means 32.

In accordance with the immediately preferred embodiment of the instant invention, spindle means 32 comprises a pair of pillow blocks 34 and 35 upstanding from and affixed to base plate 37 by machine screws 38 in accordance with conventional practice. Machine screws 38 are further utilized to secure base plate 37 to base 23. Reinforcing bar 39, extending substantially parallel to base plate 37, is affixed at the respective ends to pillow blocks 34 and 35 by additional machine screws 38.

Pillow block 34 is off-set from the center of base 23 in a direction toward the right side 27. Similarly, pillow block 35 is off-set in a direction toward the left side 28. Spindle 40 is rotatably supported by the spaced apart pillow blocks 34 and 35. Spindle 40 is rotatable about the longitudinal axis thereof represented by the broken line A. As seen with further reference to FIGS. 2 and 3, spindle 40 projects through pillow block 35 terminating with end 42 and having terminal portion 43 intermediate pillow block 35 and end 42. Cutting tool 44 projects from end 42. Although not specifically illustrated, but as will be appreciated by those skilled in the art, the opposite end of spindle 40 projects through pillow block 34 terminating with a similar configuration and carrying a second cutting tool 44.

Cutting tool 44 may be of any selected configuration in accordance with the groove desired to be cut. For purposes of illustration there is seen a cutting tool especially adapted for cutting key hole or T-slots, the specific purpose of which will be explained in detail presently. Consistent with the teachings of the instant invention, cutting tool 44 is a standard commercially available router bit. In accordance with the immediately preferred embodiment of the invention, a coaxial bore (not specifically illustrated) sized to closely receive the shank of cutting tool 44 extends into spindle 40 from end 42. Set screw 45 threadedly engaged within spindle 40 engages and retains cutting tool 44. Alternately, terminal portion 43 of spindle 44 may be provided with other conventional means, such as a collate or chuck, for holding and drivingly engaging cutting tool 44.

Drive means 33 includes motor 47 having drive pulley 48. A driven pulley 49 is carried by spindle 40. Driven pulley 49 is drivingly engaged with spindle 40 by set screw, key or other conventional means. Endless belt 50 encircles pulleys 48 and 49 to transfer rotary motion from motor 47 to spindle 40. Motor 47 is affixed to base 23 by a conventional adjustable motor mount for regulating the tension of belt 50.

Referring again to FIG. 1, it is seen that second means 22 comprises carriage means 52 and workpiece support means 53. Carriage means 52 includes a pair of spaced apart blocks, forward block 54 and rear block 55 which are secured to the upper surface 29 of base 23 by further screws 38. Blocks 54 and 55 function as support members for supporting guide bar 57 at an elevated location above upper surface 29 of base 23. Bores 56 within blocks 54 and 55 receive respective terminal portions of guide bar 57. Bar 57 is stabilized by set screws 45 which are threadedly engaged within the blocks and tightened against the respective terminal portions.

Carriage 58 is supported upon guide bar 57. Being generally U-shaped, carriage 58 includes bridge portion 59 having upper planar surface 60 and a pair of spaced apart depending support members, forward support member 62 and rearward support member 63. For ease of manufacture, carriage 58 may be fabricated by a plate and two blocks which are united by conventional fastening means, such as machine screws.

A bore 64 extends through each member 62 and 63. The bores are aligned for receiving guide bar 57 therethrough. For ease of movement of carriage 58 along guide bar 57, each bore is provided with friction reducing means 65 such as a bushing or linear bearing. Carriage 58 is reciprocally movable along the path represented by the double arrowed line B which is parallel with the longitudinal axis of guide bar 57 represented by the broken line C. Collar 67 by virtue of set screw 68 is adjustably positionable along guide bar 57. Collar 67 functions as stop means for adjustably limiting the travel of carriage 58 in the forward direction.

Carriage means 52, including guide bar 57 and carriage 58, resides intermediate spindle means 32 and left side 28 of base 23. Accordingly, for purposes of orientation, carriage means 52 may be considered to be a left hand structure. A mirror image right hand carriage means 52A, including guide bar 57A and carriage 58A, resided out board of spindle means 32 proximate right side 27 of base 23. The carriages 58 and 58A are united by lateral member 69. Bracket 70, affixed to later member 69 at the approximate mid-point thereof, supports upstanding handle 72. The lower end of handle 72 is affixed to bracket 70 by bolt 73.

Carriages 58 and 58A, being united by lateral member 69, function in unison. The carriages are moved along the path designated by the double arrowed line B in response to operator manipulation of handle 72. The handle, being affixed to bracket 70 by bolt 73, is angularly positionable for the convenience of the operator.

Figures 2, 7, 8, 9, 10:
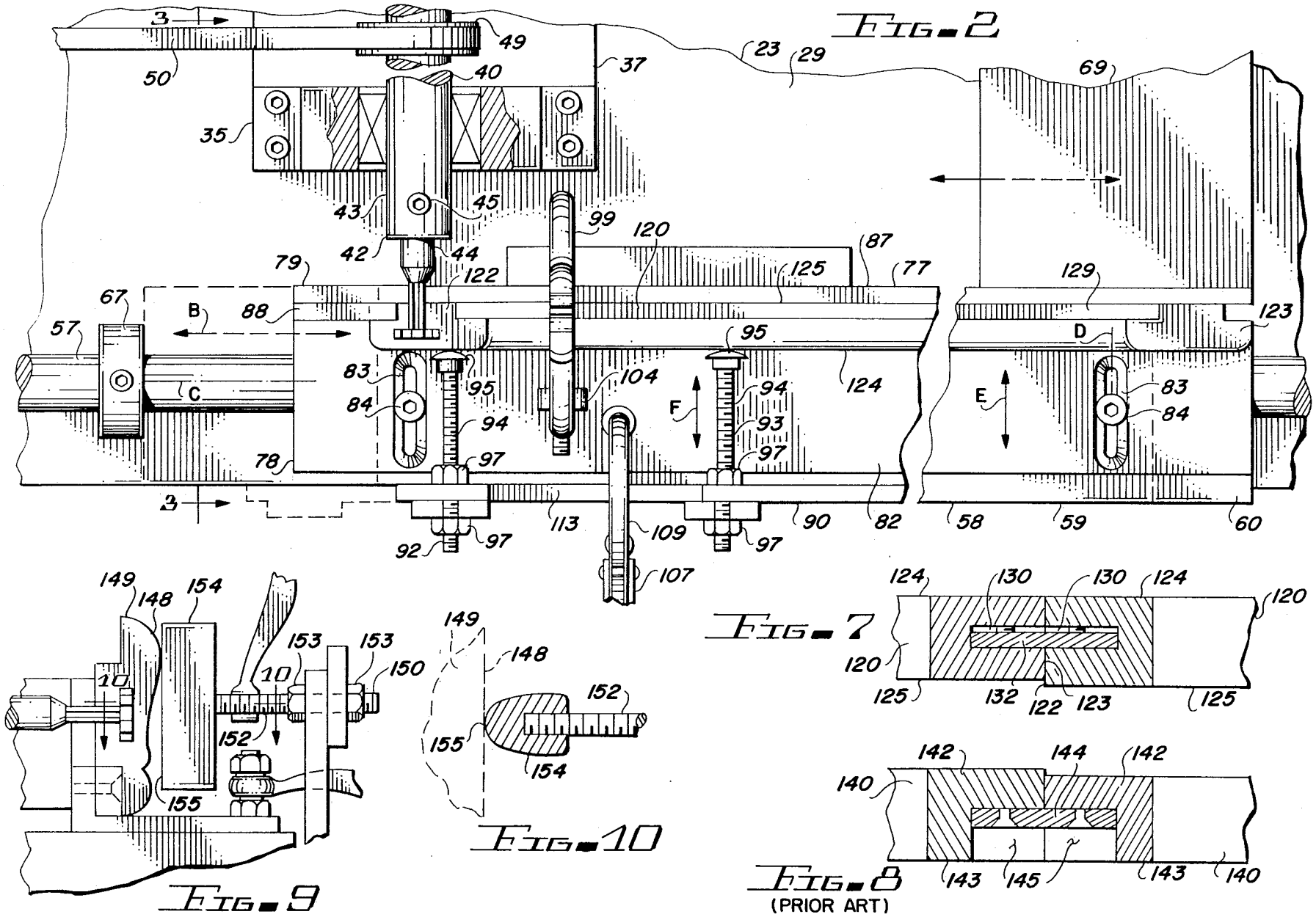
FIG. 8 (PRIOR ART)
FIG. 2 is a fragmentary top plan view, on an enlarged scale, of the right-hand portion of the device seen in FIG. 1.
FIG. 7 is a sectional view taken along the sloping line designated 7—7 in FIG. 5.
FIG. 8 is a view generally corresponding to the view of FIG. 7 and specifically illustrating a prior art teaching of joining frame members.
FIG. 9 is a view corresponding to a fragmentary portion of FIG. 3 and illustrating an alternate workpiece locating means constructed in accordance with the teachings of the instant invention.
FIG. 10 is a horizontal sectional view taken along the line 10—10 of FIG. 9.

Workpiece support means 53, also illustrated in FIGS. 1, 2 and 3, includes cross-slide 77 which, being generally L-shaped in cross-section, includes base portion 78 and upright portion 79. Base portion 78, a generally flat plate-like member includes undersurface 80 slideably disposed upon upper surface 60 of carriage 58 and top surface 82. A pair of spaced apart slots 83, each having downwardly inwardly sloping upper edge, are formed through base portion 78. Each slot 83 extends transverse of cross-slide 77, that is, along an axis respresented by the broken line designated by the reference character D and substantially parallel to the previously described axis A. A bolt or machine screw 84 extends through each slot 83 and is threadedly engaged with carriage 58. Each bolt 84 is of the flathead type so as not to project above the normal plane of surface 82. Further, the frustroconical portion of the head of bolt 84 mates with the bevel of groove 83. Slots 83 and the respective machine screws 84 function as guide means for reciprocal movement of cross-slide 77 along a path represented by the double arrowed line E.

Upright portion 79 of cross-slide 77 carries face surface 85 and rear surface 87. Stop member 88 is affixed to face surface 85 of upright portion 79 proximate the forward end of cross-slide 77. It is noted that the rearwardly directed surface 89 of stop member 88 resides at an angle which slops downwardly forward.

Flange 90 extends upwardly along the outboard edge of carriage 58. First and second stops 92 and 93 are carried by flange 90. Each stop 92 and 93 includes an elongate threaded shank 94 and a semi-spherical head 95. A nut 97 is engaged with shank 94 on either side of flange 90. Head 95 resides in opposition to face surface 85 of upright portion 79 of cross-slide 77. Shank 94 extending through an opening in flange 90 is movable along a path represented by the double arrowed line F. As a result of loosening and tightening respective nuts 97, the location of head 95 relative surface 85 is selectively adjustable. A carriage bolt has been found to be satisfactory for this purpose.

First clamp means 99, for engaging and holding the workpiece as will be explained presently, is carried by cross-slide 77. First clamp means 99 includes first and second opposed jaws 100 and 102 which are actuated by handle 103. For convenience, first jaw 100 is affixed to the rear surface of upright portion 79. Jaw 102 which carried adjustable foot 104 resides in opposition to face surface 85.

Second clamp means 107 having first jaw 108 affixed to carriage 58 and second jaw 109 carrying adjustable foot 110 which is receivable against top surface 82 of base portion 78, is actuated by handle 112. Flange 90 is provided with recess 113 for accommodating jaw 109. First and second clamp means 89 and 107, respectively, may be in the form of conventional commercially available toggle clamps.

Carriage means 58A is provided with mirror image components corresponding to the previously described components carried by carriage means 58. Included, for example, is cross-slide 77A, flange 90A and first and second clamp means 99A and 107A, respectively.

In accordance with the immediately preferred embodiment of the instant invention, a relationship exists between the several previously described axes and paths of travel. With reference to the previously noted orientation for purposes of understanding, all axes and paths of travel when viewed in elevation lie in planes which are substantially horizontal and parallel to top surface 29 of base 23. When viewed in elevation, the axes represented by the broken lines A and D and the paths of travel represented by the double arrowed lines E and F lie in parallel planes which are lateral with respect to the machine as illustrated in FIG. 1. The path of travel represented by the double arrowed line B and the axis represented by the broken line C lie in planes which are mutually parallel extending longitudinally of the machine and perpendicular to the previously designated axes and paths of travel.

Referring now to FIGS. 2 and 3, there is seen an elongate member 120 which is typically representative of such members utilized in the fabrication of a frame structure. In accordance with conventional practice, four such members are joined end-to-end to form a four-sided parametric frame structure. For this purpose, ends 122 and 123 are mitered. Member 120 further includes face side 124, rear side 125, inner edge 127 and outer edge 128. Rabbet 129, extending along the apex of rear side 125 and inner edge 127, accommodate the glass, picture or other material to be displayed within the completed frame.

The machine hereinbefore described is especially adapted for mass production preparation of elongate members. More specifically, a groove is cut into each end of each member for purposes of automatically aligned joining. Prior to mass production, as will be readily appreciated by those skilled in the art, certain adjustments and settngs must be made during a procedure which is commonly termed "set-up".

During the initial stage of set-up, a pair of identical cutting tools are secured to the respective ends of spindle 40. Carriages 58 and 58A are moved rearwardly, in response to operator pressure upon handle 72, to a workpiece loading and unloading position. Member 120 is placed upon cross-slide 77 such that rear surface 125 of the workpiece lies in juxtaposition with face surface 85 of upright portion 79 and outer edge 128 of the member 120 lies in juxtaposition with top surface 82 of base portion 78. Member 120 is pushed forwardly to abut stop member 88. Surface 89 matingly received end 122. As the terminal step of securing the workpiece, first clamp means 99 is actuated to bring foot 104 into contact with face side 124 of elongate member 120. It is noted that first clamp means 99 functions as retension means for temporarily holding elongate member 120 in a predetermined location upon cross-slide 77.

Next, elongate member 120 is locationally positioned with respect to cutting tool 44. For this purpose, the carriage assembly, carriages 58 and 58A, are moved forwardly until end 122 resides in close proximity to cutting tool 44 as seen in FIG. 2. Cross-slide 77 is then moved along the path described by the double arrowed line E until end 122 resides at the desired location relative cutting tool 44. In otherwords, the location of the bottom of the groove between sides 124 and 125 is established. Stops 92 and 93 are then adjusted such that heads 95 abut surface 124. This insures that the location can be repeated during the cutting of subsequent elongate members. Second clamp means 107 is now actuated to locationally retain cross-slide 77. Finally, collar 67 is located along guide bar 57 at a selected distance forward of carriage 58 to establish the length of the slot to be cut into elongate member 120.

A similar procedure of establishing limits and adjustments is conducted with respect to carriage means 52A and workpiece support means 53A. It is noted, however, that the corresponding groove is cut into end 123 of elongate member 120. Accordingly, the corresponding settings must be made at locations which will provide for aligned joining of the several members.

During regular or continuing operation, an elongate member is positioned upon each cross-slide and secured thereto by the respective clamping means. Each cross-slide is then moved outwardly bringing the elongate member into contact with the respective stops. The second clamp means are then activated. With motor 47 energized and rotating spindle 40, the carriage assembly is then urged forwardly bringing the elongate members into contact with the cutting tools 44 for cutting the respective slots. The cutting operation continues until the carriage assembly abuts the collars. Subsequently, the carriage assembly is withdrawn rearwardly, the elongate members removed and the procedure is reinitiated.

FIG. 4 illustrates a pair of elongate members 120 into which T-slots 130 have been formed into the end 122 and 123 utilizing the previously described machine. Also illustrated is a corner bracket 132 such as the one sold under the tradename Tapped Corner TM. The bracket includes a planer generally L-shaped element 133 having legs 134 and 135. A plurality of tapped holes 137 extends through each leg for receiving set screws 138.

The members 120 are joined in accordance with conventional techniques reserved, before the advent of the instant invention, for metallic members. Legs 134 and 135 are entered into the respective grooves 130 and the ends 122 and 123 brought together and abutted as seen in FIG. 5. The several set screws 138 are then tightened, as seen in FIG. 6, bringing the L-shaped element against one surface of the slot while the set screw abuts the opposing surface of the slot.

As will be appreciated by those skilled in the art, fastener 132 automatically brings the slots 130 of the respective elements into automatic alignment as illustrated in FIG. 7. In accordance with the teachings of the instant invention, the slots 130 are located from the front face 124 of the elongate members 120. Resultingly, the face surfaces 124 of the members 120 are automatically aligned during assembly. Any variations in the thickness of the members will be apparent along the rear surfaces 125.

By contrast, there is seen in FIG. 8 a pair of frame members 140 having face sides 142 and rear sides 143 joined by a conventional angle bracket 144 residing in open grooves 145. Consistent with the teachings of the prior art, the grooves 145 are located from the surface 143. Accordingly, any difference in thickness of the members 140 is apparent on the face of the frame structure which is present for view.

For purposes of illustration, face surface 124 of elongate member 120 was chosen to be relatively plain. Attention is directed to FIG. 3 wherein the contour of surface 124 is especially apparent. Frequently, the face side of an elongate member is ornately contoured as represented by face side 148 of elongate member 149 seen in FIG. 9. To accommodate extremely ornate face surfaces, the instant invention contemplates an alternate stop 150 which in general similarity to previously described stops 92 and 93 includes elongate threaded shank 152 and nuts 153. Head 154 having contact surface 155 opposing face surface 85 of upright portion 79 of cross-slide 77 is carried at the inboard end of shank 152. As viewed in elevation, surface 155 is substantially parallel to surface 85. In plan, as seen in FIG. 10, surface 155 is arcuate. Accordingly, surface 155 will abut, for location purposes, the most projecting point of a contoured surface. It is apparent, therefore, that head 154 is especially adapted for use in connection with highly ornately contoured surfaces.

The instant invention also provides means for selectively locating groove 130 relative the edge 128 of the member 120. In the previously described embodiment the location of the groove was predetermined as a distance above top surface 82 of cross-slide 77. For narrower members, it is necessary that edge 128 be elevated in order to cut the groove at a location intermediate edges 128 and 127. With reference to FIG. 11, there is seen a preferred embodiment of means for elevating edge 128 above surface 82. The embodiment includes a plurality of spacers 160 which are placed upon surface 82 for receiving surface 128 thereon. A sufficient number of spacers in selected widths may be chosen in order to provide the desired height. Further, each spacer is elongate having a length sufficient for adequate support of the member 120.

FIG. 12 illustrates an alternate embodiment thereof utilizing spacers 162, each having at least one bore 163 extending therethrough. The lower portion of each bore 163 is sized to receive and retain the upper portion of a pin 164. The upper portion of each bore 163 is sized to closely and slideably receive the lower end of pin 164. The respective bores 163 are aligned such that when the spacers 162 are stacked, as seen in FIG. 12, the depending portion of the pin 164 of each successive spacer 162 is received in the upper portion of the bore 163 of the lower spacer 162. Bore 165 in lower portion 178 receives the depending portion of the pin 164 carried by the lowermost spacer 162. The arrangement of pins and bores locationally position and retain the several spacers. As will be appreicated by those skilled in the art, an additional arrangement of pins and bores may be provided at a spaced apart longitudinal location.

FIG. 13 illustrates a more permanent, yet removable, spacer 167. One or more countersunk bores 168 extend through spacer 167 and are aligned with corresponding threaded bores 169 carried in base portion 78. A flat head machine screw 170 passes through each bore 168 and is threadedly engaged with the bore 169 for detachably retaining the spacer 167.

Spacer 172, seen in FIG. 14, is generally analogous to the previously described spacers 162 having a bore 173 in which is received and retained pin 174. Base portion 178 is provided with a plurality of bores 175 spaced to alternately and selectively receive the pins 174. Accordingly, the lateral position of spacer 172 is adjustably positionable. The immediate embodiment is especially adapted for receiving exceedingly wide frame members in which the edge to be located from sides at an extended distance from surface 85. Further, spacer 172 can be located so as to provide a recess between the inner edge thereof and surface 85 to accommodate ornamentation carried by the frame member intermediate edge 128 and rear face 125.

Various changes and modifications to the embodiments herein chosen for purposes of illustration will readily occur to those skilled in the art. To the extent that such modifications and variations do not depart from the spirit of the invention, they are intended to be included within the scope thereof which is assessed only by a fair interpretation of the following claims.

Having fully described and disclosed the present invention and alternately preferred embodiments thereof in such clear and concise terms as to enable those skilled in the art to understand and practice the same, the invention claimed is:

1. An apparatus for cutting a groove in a longitudinal workpiece having a face surface, a rear surface, inner and outer edges, and first and second ends, for the aligned joining of at least two such work pieces, comprising;

a base having a forward end, a rearward end, a right side, a left side, and an upper surface;

first means coupled to said base for locating and supporting said work piece; and second means coupled to said base for cutting a longitudinal groove in said work piece to a depth which is a predetermined distance from said face surface, said second means including a cutting tool, spindle means having a first longitudinal axis for rotatably supporting said cutting tool, and drive means coupled to said spindle means for imparting rotary motion thereto;

said first means including carriage means coupled to said base, and work piece support means coupled to said carriage means;

said carriage means comprising a pair of spaced apart blocks fixedly coupled to said base, a longitudinal guide bar coupled to and supported by said pair of spaced apart blocks at an elevated location above said base, said guide bar having a second longitudinal axis substantially perpendicular to said first longitudinal axis, and a carriage slidingly supported on said guide bar wherein said carriage is U-shaped and comprises a bridge portion and a pair of spaced apart support members depending from terminal portions of said bridge portion.

2. An apparatus according to claim 1 wherein a bore extends through said pair of spaced apart support members for receiving said guide bar therethrough.

3. An apparatus according to claim 2 further comprising friction reducing means coupled within the bore in each of said pair of spaced apart support members.

4. An apparatus according to claim 1 further comprising a collar adjustably positionable on said guide bar for limiting movement of said carriage on said guide bar.

5. An apparatus according to claim 1 wherein said workpiece support means comprises an L-shaped cross slide member having a generally flat plate-like base portion slideably disposed on said carriage in a direction substantially parallel to said first longitudinal axis and having an upright portion coupled to said base portion.

6. An apparatus according to claim 5 further comprising a plurality of spaced apart slots extending through said base portion, and means extending through said slots and engaging said carriage for positionally securing said cross slide on said carriage.

7. An apparatus according to claim 5 wherein said workpiece rests on said base portion with its rear surface against said upright portion.

8. An apparatus according to claim 7 further comprising stop means fixedly coupled to said upright portion for abutting an end of said workpiece.

9. An apparatus according to claim 8 wherein said workpiece includes a mitered end and wherein said stop means includes an inclined edge for engagingly receiving said mitered edge.

10. An apparatus according to claim 7 further comprising a flange coupled to and extending upwardly from said carriage, and at least one stop member carried by said flange, said at least one stop member residing in opposition to said face surface of said workpiece.

11. An apparatus according to claim 7 further comprising spacer means disposed on said base portion for raising said workpiece.

12. An apparatus according to claim 11 wherein said spacer means is adjustably positionable on said base portion.

13. An apparatus according to claim 10 wherein said at least one stop member has a head, the location of which is selectively adjustable.

14. An apparatus according to claim 13 wherein said at least one stop member is a carriage bolt.

15. An apparatus according to claim 7 further comprising first clamp means coupled to said cross slide for holding said workpiece.

16. An apparatus according to claim 15 wherein said first clamp means comprises first and second opposed jaws, and handle means for actuating said jaws.

17. An apparatus according to claim 16 wherein said first jaw is fixed to said upright portion and said second jaw includes an adjustable foot which resides in opposition to said first surface of said workpiece.

18. An apparatus according to claim 15 further comprising second clamp means coupled to said carriage for maintaining said cross slide in a desired location.

19. An apparatus according to claim 18 wherein said first and second clamp means are toggle clamps.

* * * * *